US005309745A

United States Patent [19]

Ursel et al.

[11] Patent Number: 5,309,745

[45] Date of Patent: May 10, 1994

[54] INTERLOCKING DEVICE FOR DOORS OF A MOTOR VEHICLE

[75] Inventors: Eckhard Ursel, Buehl; Uwe Schaper, Buehl-Vimbuch, both of Fed. Rep. of Germany

[73] Assignee: Robert Bosch GmbH, Stuttgart, Fed. Rep. of Germany

[21] Appl. No.: 950,944

[22] Filed: Sep. 24, 1992

[30] Foreign Application Priority Data

Sep. 25, 1991 [DE] Fed. Rep. of Germany ..... 4131891

[51] Int. Cl.[5] ..... E05B 53/00

[52] U.S. Cl. ..... 70/264; 70/275; 292/201; 292/216

[58] Field of Search ..... 70/262–264, 70/275, 277, 279; 292/201, 207, 216, 280, DIG. 23

[56] References Cited

U.S. PATENT DOCUMENTS

| | | | |
|---|---|---|---|
| 3,064,752 | 11/1962 | Deibel et al. | 70/262 X |
| 3,653,237 | 4/1972 | Durocher | 70/264 |
| 4,452,058 | 6/1984 | Noel | 70/264 X |
| 4,664,430 | 5/1987 | Bernard | 292/216 X |
| 4,763,936 | 8/1988 | Rogakos et al. | 292/201 |
| 4,775,176 | 10/1988 | Ikeda | 292/216 |
| 4,850,625 | 7/1989 | Hori et al. | 292/216 X |
| 4,948,183 | 8/1990 | Yamada | 292/201 X |
| 4,986,098 | 1/1991 | Fisher | 70/262 |
| 4,986,579 | 1/1991 | Ishikawa | 292/216 X |
| 5,007,261 | 4/1991 | Quantz | 292/216 X |
| 5,046,341 | 9/1991 | Ogino et al. | 70/264 |
| 5,078,436 | 1/1992 | Kleefeldt et al. | 292/216 X |
| 5,137,311 | 8/1992 | Brackmann et al. | 292/216 |
| 5,180,198 | 1/1993 | Nakamura et al. | 70/264 X |

FOREIGN PATENT DOCUMENTS

| | | | |
|---|---|---|---|
| 3150620 | 6/1983 | Fed. Rep. of Germany . | |
| 3933432 | 5/1990 | Fed. Rep. of Germany | 70/264 |
| 4015522 | 3/1991 | Fed. Rep. of Germany . | |
| 3-25179 | 2/1991 | Japan | 70/262 |
| 2222203 | 2/1990 | United Kingdom | 70/262 |

*Primary Examiner*—Peter M. Cuomo
*Assistant Examiner*—Suzanne L. Dino
*Attorney, Agent, or Firm*—Michael J. Striker

[57] ABSTRACT

A central interlocking system for a motor vehicle performs in a normal operation all opening and closing functions. A vehicle provided with the system can be opened and locked without the operation of door closing motors. The outer and inner handles can be selectively blocked individually and jointly by a motor operated control member having two parallel control discs which cooperate with two locking levers. The control member can be released for opening of the door also in a purely mechanical way by turning a door lock keybolt with a key. The locking system has a simple construction and locking motors operating without loads.

13 Claims, 7 Drawing Sheets

INTERLOCKING DEVICE FOR DOORS OF A MOTOR VEHICLE

BACKGROUND OF THE INVENTION

The present invention to an interlocking device for doors of a motor vehicle.

German reference DE 31 50 620 Al discloses an electric motor driven door lock for a motor vehicle, in which a rotary catch is brought in its locking position via a crank drive and a toggle lever arrangement. A door which is locked in this way cannot be opened without a motor drive from the interior of the vehicle. In known constructions a relatively great number of individual parts are required for a limited number of operations.

SUMMARY OF THE INVENTION

Accordingly, it is an object of the present invention to provide an interlocking device for doors of a motor vehicle which avoids the disadvantages of the prior art.

In keeping with these objects and with others which will become apparent hereinafter, one feature of the present invention resides, briefly stated, in an interlocking device for doors of a motor vehicle, which has a plurality of locks associated with at least doors and including at least one lock for example for a driver's door provided with a locking cylinder actuated from outside by a key and the locks have an interlocking element in particular a rotary catch cooperating with the holding element and is blockable in a closed position by a blocking element and unblockable under action of an unlocking lever whose movement is influenced by the position of a control member displaceable by a motor, wherein in accordance with the present invention two independently turnable unlocking levers are provided of which one unlocking lever is actuated by an outer door handle and another unlocking lever is actuated by an inner door handle, and a control member cooperates with control segments which are differently formed for each unlocking lever.

When the interlocking device is designed in accordance with the present invention the individual door locks have considerably simpler construction and moreover it performs all opening and closing functions in a normal operation and in the case of emergency. The interlocking device is designed so that the vehicle also, in the event of failure of an electrical component, with bypassing the central locking operation, can be opened as usual and unlocked. In order to obtain a compact construction of the interlocking device the motor associated with each door lock can be exceptionally small since it applies only a very low force.

The construction of the inventive device as specified hereinabove has the advantage that the lock can be opened easily in any way either only from inside, only from outside, or from inside or from outside or from inside and outside. Thereby in a simple manner the operational positions can be unlocked, centrally locked, theft protected and children secured.

In accordance with an especially advantageous further embodiment of the present invention, a control member is associated with both independently turnable unlocking levers with control segments which are locked in pairs and unlocked in pairs.

In accordance with a further advantageous feature of the present invention, the control member is formed as a signal transmitter which is turned load-free by a motor only, without actuating a further lever. The control member is not subjected to any spring forces which must be overcome in the prior art. Since the control member in each operating position is load-free up to pure signal functions, very weak and small motors are sufficient. Preferably, the motor is short-circuit-secure to prevent damages during unauthorized actuation of the door handle. The motor is advantageously mounted on a turning frame in which also the control member is supported. By means of a device for position detection of the control member, for example Hall sensors, the control electronic unit can determine the respective position of the control member and the motor can be brought to the desired control position.

In accordance with a further feature of the present invention, at least one door of the vehicle in the event of complete current failure during failure of the door closing motor or breakdown of the electronic control, can be opened with a key. This is achieved in an advantageous manner in that, without actuation of the control member, the turning frame which holds the control member is turned back so that the unlocking levers are movable without resistance.

It is further advantageous when an emergency key bolt is mounted on all doors via preferably covered lever or pushbutton and is manually actuatable. By means of the emergency key bolt the outer door handle can be blocked independently from the motor operation, so that the vehicle can be blockable any time in the case of current or motor failure. This is used by the user of the conventional mechanical blocking doors in vehicles without central locking units. The emergency key bolt can be unlocked without a key only from the interior of the vehicle, either by pulling the inner door handle or by the covered lever or pushbutton. A further advantage is that the door lock key bolt which is mechanically actuated by an outwardly accessible locking cylinder simultaneously unlocks the emergency key bolt during releasing of the control member.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 4 and 5 show the operational position unlocked;

FIGS. 6 and 7 show the position of central locking;

FIGS. 8 and 9 show the position of the protection in pairs in correspondence with sections A—A and B—B in FIG. 2;

FIG. 10 is a view showing the operational position theft protected and emergency key-bolted.

DESCRIPTION OF THE PREFERRED EMBODIMENTS

Figure 1:
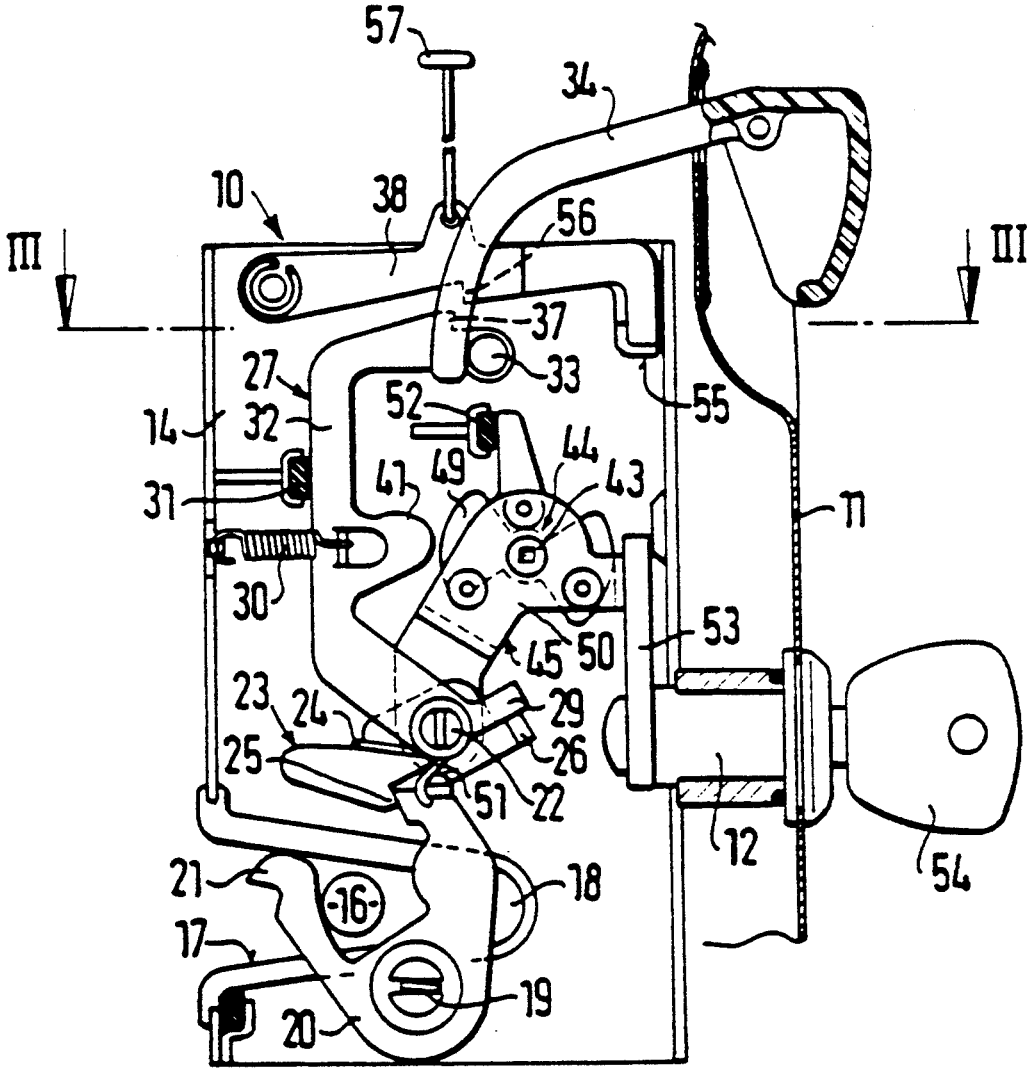
FIG. 1 is a front view of a door lock for a front door in accordance with the present invention.

An interlocking device for a vehicle has a door lock 10 associated with each door of the motor vehicle. The door locks for example for a front door 11 which is shown in a section in the drawing are provided with outwardly accessible locking cylinders 12. The trunk hood and the tank flap are also provided with corresponding locks.

Each individual door lock 10 has a supporting plate 14 for supporting further parts associated with the lock. The supporting plate 14 is preferably laterally bent and closed with a not shown cover. Each door lock has a holding element formed as a closing pin 16 arranged on a door frame which is fixed to a chassis and insertable during closing of the door 11 in a slot-shaped recess 17 of the supporting plate 14. A rubber buffer 18 is arranged at the end of the recess 17, and a locking element cooperating with the locking pin 16 abuts against the rubber buffer. The locking element is formed as a rotary catch 20 which is rotatable about an axis 19. A blocking element 23 which is rotatable about an axis 22 is arrestable with legs 21 of the rotary catch. In FIG. 1 a known first locking stage and in FIG. 6 a second locking stage are shown. The locking stages are described for example in the German document DE 40 15 522 Al. The blocking element 23 is pressed to its arresting position by a return spring 24, so that a locking pawl 25 engages behind the respective leg 21. The blocking element 23 deviates back during closing of the door, when the leg 21 from the recess 17 touches the closing pawl 25. The blocking element 23 at its side which is opposite to the axle 22 of the blocking pawl 25, has an arm 26 which is angled in direction of the axle 22 and is extended.

Two approximately coinciding unlocking levers 27 and 28 are arranged near one another rotatably about the axle 22. The unlocking levers 27 and 28 each have a projection 29 abutting against the arm 26. In its rest position shown in FIG. 1, the unlocking lever 27 or 28 is retained by a pulling spring 30 to abut against an abutment 31. The unlocking levers 27, 28 each have an actuating arm 32 with an end provided with a laterally projecting pin 33 for engaging an outer door handle 34. The unlocking lever 28 carries, instead of a pin 33, an ear 35 in which a cable for an inner door handle 36 is suspended (see also FIG. 5). The unlocking lever 27 has a projection 37 provided near the pin 33, and an emergency key bolt 38 is engageable in it. The unlocking lever 27 has at the same location an incline 39 which is not arrestable with the emergency key bolt 38, for actuating from inside.

For opening of the door, at least one of the unlocking levers 27, 28 is deflected from the abutment 31 for disengaging of the blocking member 23. The deflection of the unlocking levers 27, 28 in the operational locked position is prevented in the following manner. The unlocking levers 27, 28 both carry in the middle of their actuating arm 32 a projection 41 pointing away of the abutment 31. The projections are oriented on a shaft 43 of a control member 44 which is held rotatably in a turning frame 45. The control member 44 is formed by two parallel control discs 47 and 48. The control discs are fixedly connected with the shaft 43 and have several control segments, for example four quarter-circle shaped segments. FIG. 1 shows two solid control segments 49 and two recessed control segments 50 located opposite to one another. Also, more or less than four control segments can be provided per control disc 47, 48.

Figure 5:
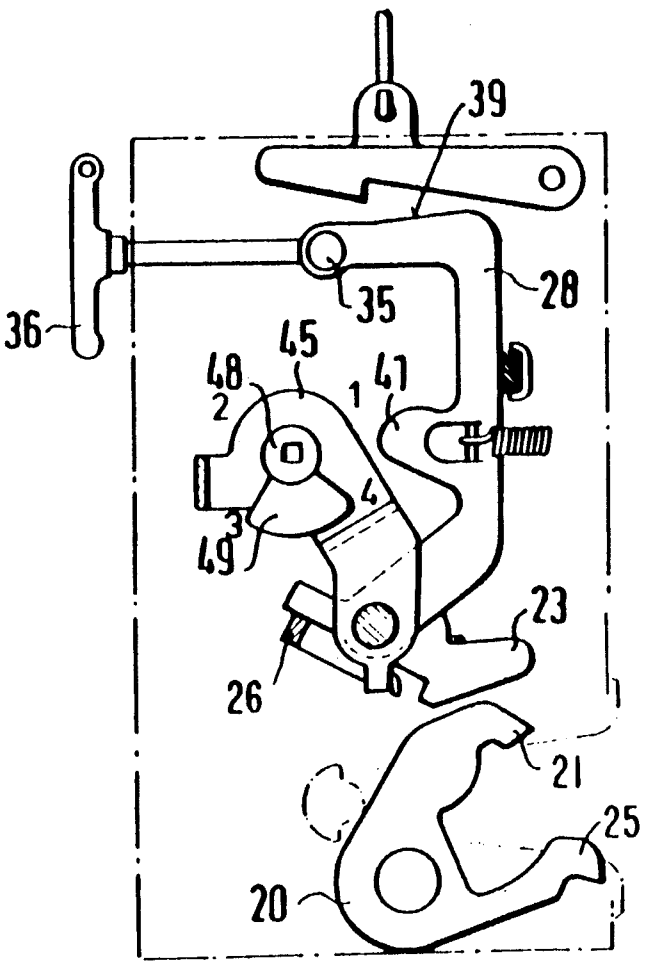
FIGS. 4–10 are views showing different operational positions of the front door.
Figure 4:
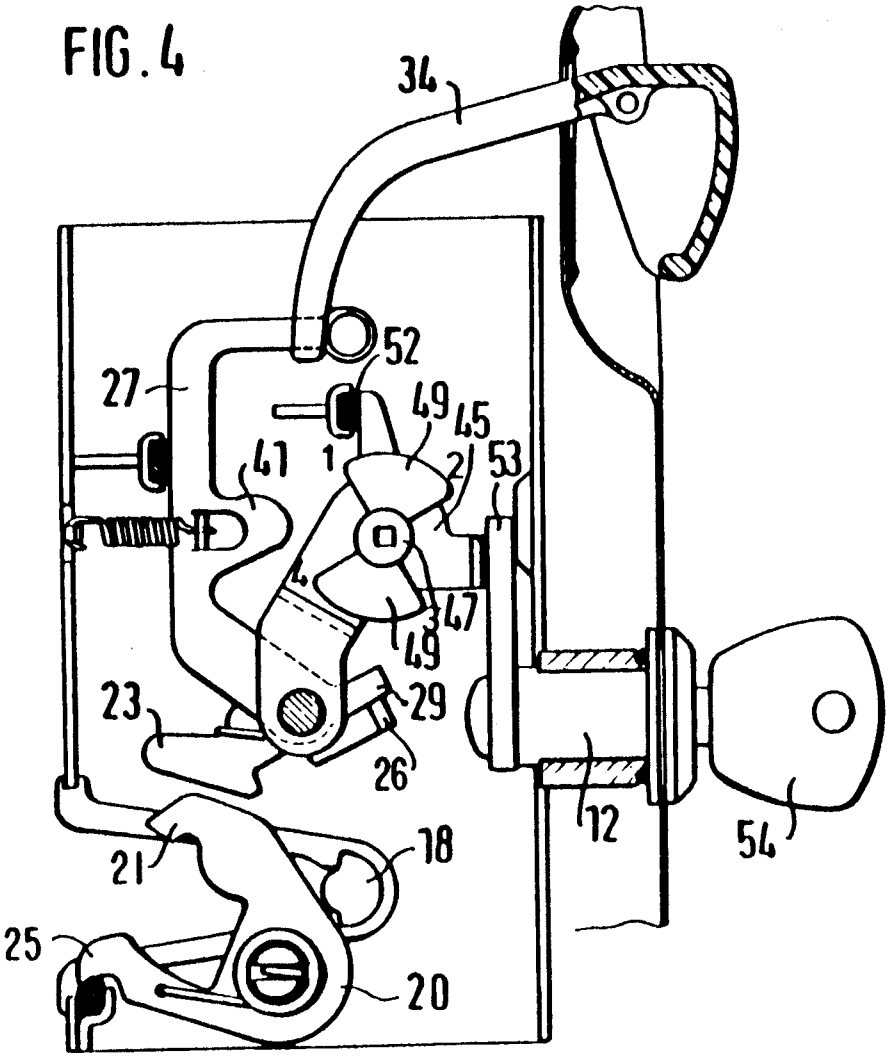

In FIG. 4 and 5 the control segment borders are identified by numerals. The control disc 47 is solid between 1 and 2, cut out between 2 and 3, again solid between 3 and 4, and again cut out between 4 and 1. The control disc 48 in FIG. 5, contrary to this is solid only in the control segment between 3 and 4 and in the remaining three segments is cut out. The numbering of the segment borders is selected so that each control segment with the identically numbered segment borders comes to abutment against the projections 41 of the control lever, while the control disc 47 is always associated with the lever 27 and the control disc 48 is always associated with the lever 28.

Figure 2:
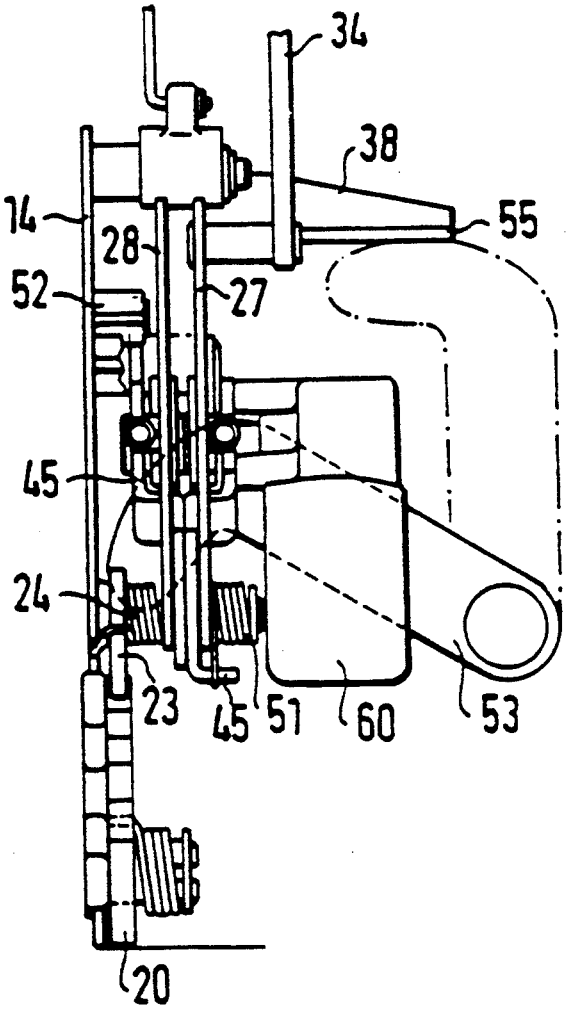
FIG. 2 is a side view of the door lock of FIG. 1.
Figure 3:
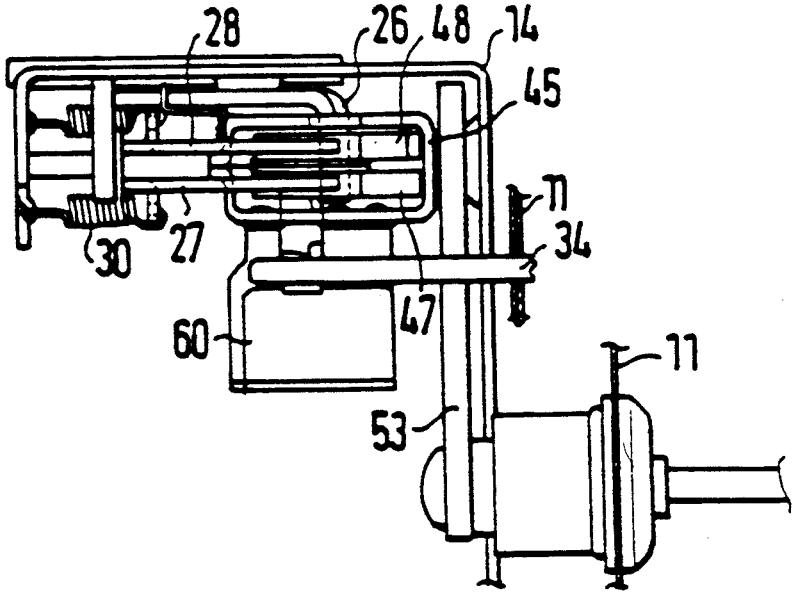
FIG. 3 is a view showing a section taken along the line III—III in FIG. 1.

The turning frame 45 is rotatably supported in the axle 22 and is held by a weak spring 51 with its upper end against an abutment 52. The spring 51, as the spring 24 is arranged as a spiral spring on the axle 22. Moreover, the turning frame is fixedly and non-rotatably fixed by a door lock key bolt 53 relative to the supporting plate 14. The door lock key bolt 53 is connected with the locking cylinder 12 so that starting from a predetermined average rotary angle it turns together with the key 54. FIG. 2 shows in solid lines the normal position of the door lock key bolt 53 in which it abuts against the turning frame 45, and in broken lines the emergency unlocked position. The door lock key bolt 53 extends outwardly to the emergency key bolt 38 and acts against a running surface 55 of the emergency key bolt. In the position of the emergency key bolt 38 shown in FIG. 6, its arresting projection 55 is disengaged from the projection 37 of the unlocking lever 27. A push button or another actuating member is arranged on the emergency key bolt 38 in the region of the arresting projection 56, through a rod or a cable. It is located on the inner side of the vehicle door 11 preferably concealed and can operate for manually bringing the emergency key bolt 38 to its both positions.

A small electric motor 60 with its housing is mounted on the turning frame 45. The drive shaft of the motor 60 or a rotary speed reduction is provided for example with a worm pinion, and a worm wheel supported coaxially with the control member 44 engages in the worm pinion. In every case a rotary fixed connection between the motor shaft and the control member 44 is produced. At a suitable location, for example between the turning frame 45 and the control member 44, an arrangement for position termination of the control member 44 is provided. It can be formed for example by Hall sensors or microswitches associated with the control segments 49 and 50.

Electrical contacts are arranged in the locking cylinder 12. They are activated at a low turning angle of the key 54, for example of 20° and produces a pulse at a not shown control electronic unit. For example selecting or withdrawing the position for "shaft protection", the other operational positions are selected preferably by a switch on the dashboard. Via the control electronic unit the control member 44 is brought by the motor 60 to the desired position over the shortest path. The not shown contacts in the locking cylinder 12 are selected so that they are activatable before the door lock key bolt 53 is set mechanically in movement. This can be provided in that the door lock key bolt is mounted on the locking cylinder 12 with a certain rotary play of for example 45°.

Different operational positions of the lock 10 are shown in further Figures. FIGS. 4 and 5 show an unblocked, open vehicle door. In FIG. 4 projection 41 of the unlocking lever 27 extends in one cut off control segment 50 of the control disc 47. The unlocking lever can be moved in by pulling of the outer door handle 34 on the control member 44. Thereby the projection 29 presses against the arm 26 of the blocking element 23, so that its locking pawl 25 releases the leg 21 of the rotary catch 20 in the shown position, in which the door is open.

Depending on the actuation of the outer door handle 34, the door can be opened by pulling of the inner door handle 36. It acts on the unlocking lever 28 whose projection 41 in turn hits a cutout control segment 50. The blocking element 23 is unlocked in the above described manner so that the rotary catch 20 is released.

Figure 7:
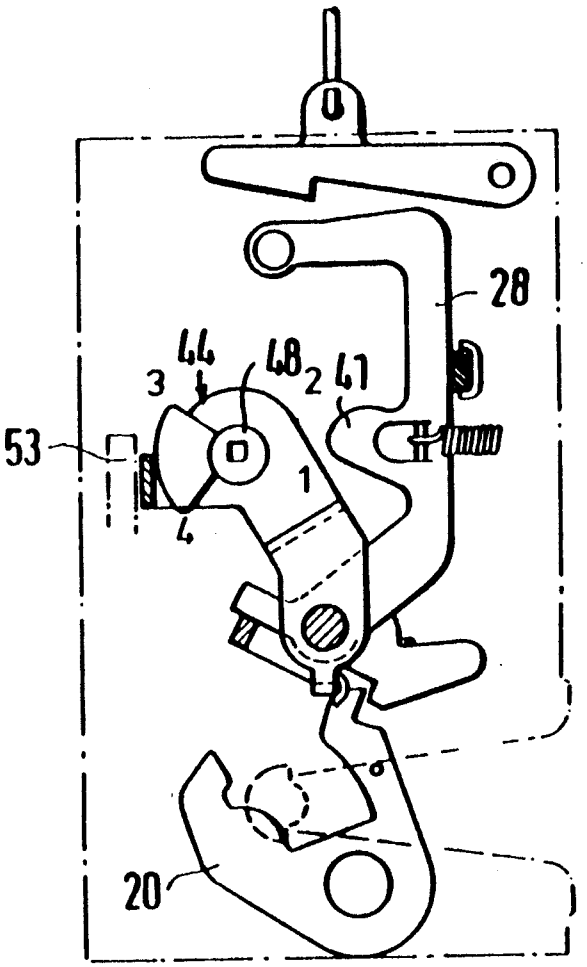
Figure 6:
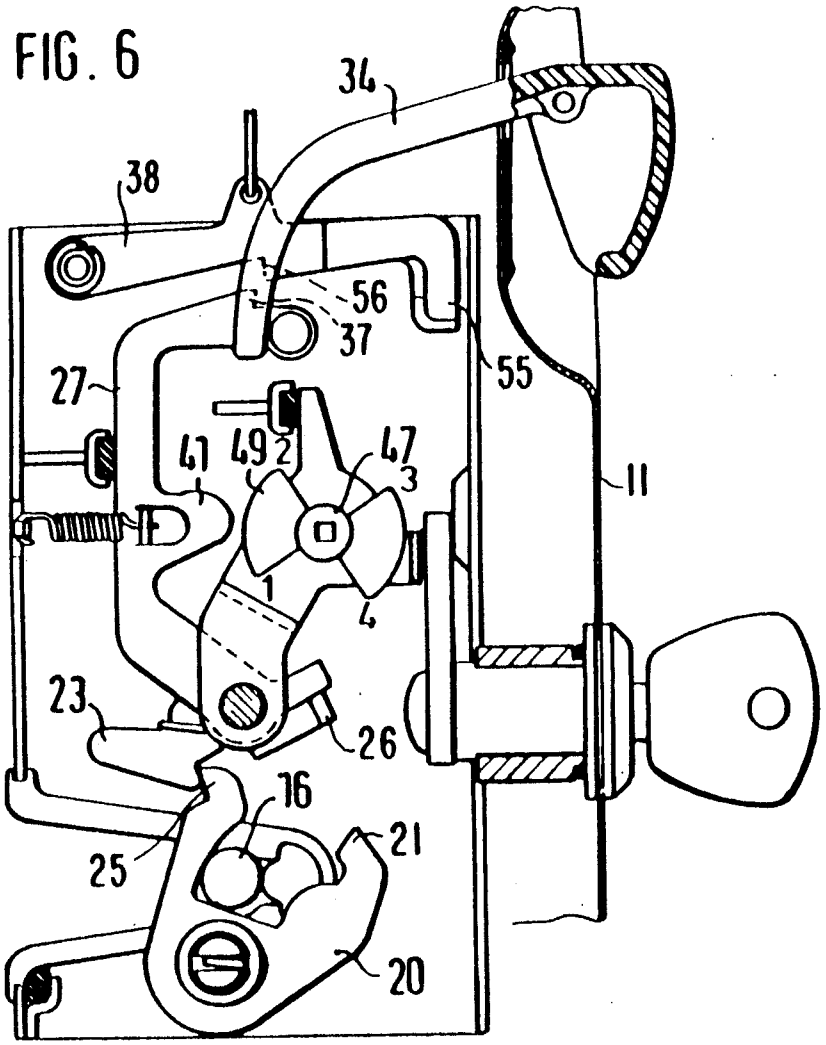

In FIGS. 6 and 7 the lock 10 is shown in its central locked position. The control discs 47 and 48 extend with their control segments located between 1 and 2, to the projections 41 of the unlocking levers 27 and 28. In the case of the control disc 47 it is a massive control segment 49 which projects over the projection 41 so that the control lever 27 cannot be turned to the right so far that the blocking element 23 releases the rotary catch 20. The door cannot be opened from outside. From FIG. 7 it can be seen that the locking lever 28 can be moved without problems on the control member 44. An opening of the door from inside is also possible by pulling the inner door handle.

Figure 9:
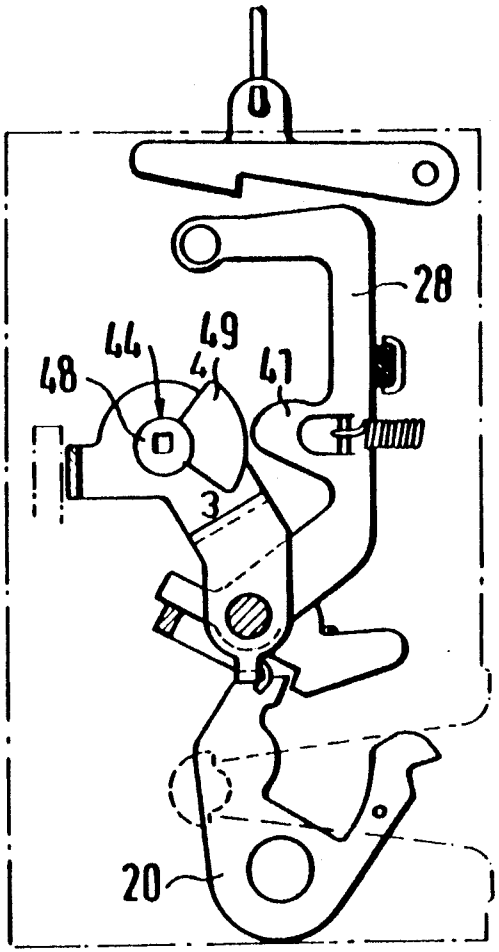
Figure 8:
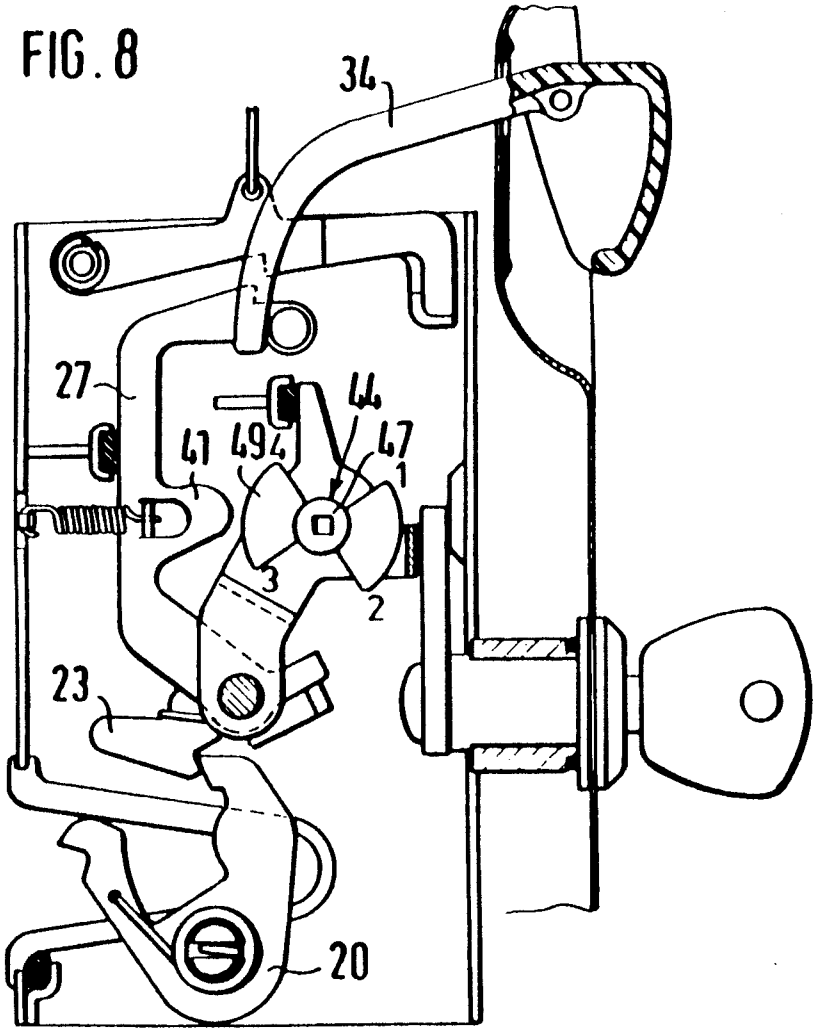

In FIGS. 8 and 9 the lock 10 is shown in the theft protected position. The rotary catch 20 is located in the first locking stage in which the theft protected position is already effective. Here the solid control segment 49 extends between 3 and 4 to the projection 41. The door can be opened without the key 54 both from inside and outside.

Figure 10:
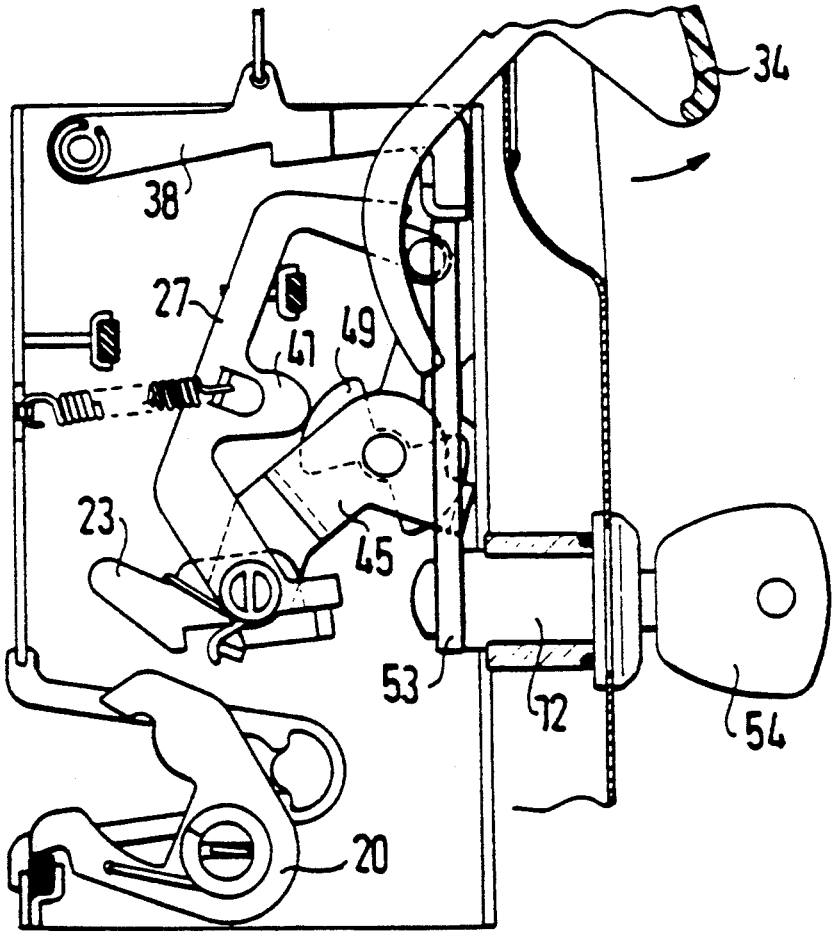

In FIG. 10 the door is however with the theft protection emergency unlocked. By turning the locking cylinder 12 with the key 54 over approximately 90°, the door lock key bolt 53 is turned upwardly so that the turning key 45 is turned back from the locking levers 27 and 28. In the drawings the positions of the structural elements are shown with the outer handle 34 pulled in the direction of the arrow. Since the control member 44 is not turned by the motor 60, the projection 41 extends to a solid control segment 49. Since however the whole control member 44 together with the turning frame 45 deviates to the side, the door as usual can be opened by pulling the outer door handle. It must additionally overcome only the low force of the spring 51.

In order to prevent the situation that the driver is mistakenly locked in the vehicle with not operative motor 60, the key 54 after the turning back of the door lock key bolt 53 cannot turn back easily, but it can be withdrawn only in a position turned by approximately 90°. Thereby, the door lock key bolt 50 remains in its turned back position, so that the turning frame 45 both during actuation of the outer door handle and also during actuation of the inner door handle remains turned out. Otherwise, an opening of the door from inside is not possible.

In order to obtain this, after approximately a quarter revolution of the key 54 a not shown springy arresting element engages in the locking cylinder 12 preventing a further or back turning. The arresting element can be again disengaged from the locking cylinder 12 for unlocking the vehicle when leaving it, by a handle, for example by actuation of a pin arranged on the locking cylinder or pressing of a concealed or countersunk member for example with the end of the lock 54.

Figure 12:
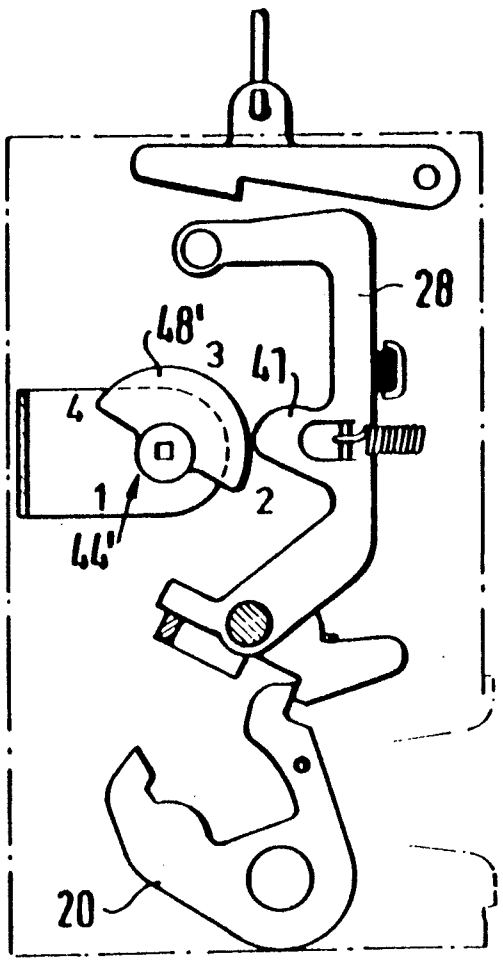
FIGS. 11 and 12 show a front door in the operational position children-protected.
Figure 11:
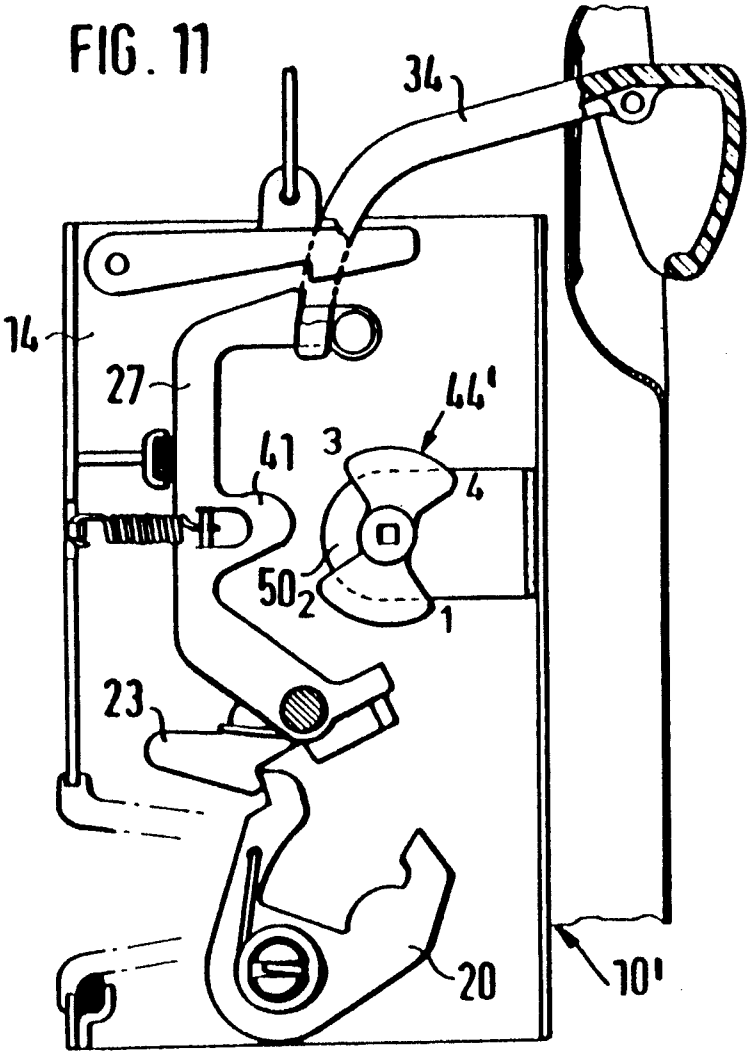

The lock 10' for the inner doors shown in FIGS. 11 and 12 differs by another construction of the control disc 48' for the opening of the door from inside, so that a locking cylinder is dispensed with. Moreover, the control member 44' here is fixedly connected with the supporting plate 14 and is not turnable.

FIG. 11 shows the lever mechanism for the outer door 34. Here the operational position "children-protected" is illustrated in which the cutout control segment 50 is located between 2 and 3 relative to the projection 41. The door can open conventionally from outside. The control disc 48 associated with the inner door of the handle or the unlocking lever 28 is however formed solid in the control segment between 2 and 3 as shown in FIG. 12. Thereby the unlocking lever 28 cannot be turned in the opening direction. The door cannot open from inside.

For all vehicle doors the following functions for different control segments of the control discs 47, 48, 48' are performed:

When the control segment is located between 4 and 1 relative to the projection 41, all doors are unlocked and can be opened from outside and from inside; this position is obtained with the key in the locking cylinder 12.

When the control segment is located between 1 and 2 relative to the projection 31, the vehicle is centrally blocked, or in other words all doors are blocked from outside and from inside. This operational position is selected for example on a switch in the inner space of the vehicle. For preventing an opening of the door by a third party from outside.

When the control discs extend with the control segments between 2 and 3 relative to the projection 41, the front door can be opened from both sides and the rear door is children-protected. In other words, it can be opened from outside, but cannot be opened from inside. This operational position is also adjusted by a switch on the dashboard.

Finally, when the control segment of the control disc is located between 3 and 4 relative to the projection 41, all doors are blocked, and they cannot be opened either from outside or from inside without a key. This operational position in which the vehicle is theft-protected, can be adjusted with the key 54 from outside.

For the case when the vehicle in view of the current failure or other problems must be locked on the electrical door locking device, it is performed by actuation of the pushbutton 57 on each individual door. By the unlocking lever 27 for the outer handle in a manner independent from the position of the control member 44 is blocked in its rest position and cannot be turned by the outer door handle 34. The arresting projection 56 on the emergency key bolt 38, and the projection 37 on the blocking lever 27 are locked relative to one another. These emergency-locked locks can however each open from inside, since the unlocking lever 28 for the inner activation has no projection, but instead inclines 39 which by pulling the inner door handle 36 bring the respective emergency key bolt 38 in its locking position.

Thereby it is guaranteed that an emergency key bolt 38 which is mistakenly operated before the raising, remains not consciously in its blocking position and the vehicle user is not irritated by locking of its car. With the operating motor 40 this door can be opened only when the lock 54 is turned sufficiently far for unlocking the emergency key bolt 38. The interlocking device can be also formed so that a door lock key bolt 53 is arranged on one door for example on the driver's door or the co-driver door.

A further feature permits the driver after actuation of the central closing device to be sure that all doors are efficiently locked. The control member 44 can be connected with indicators visible on the door frames, for example conventional projecting pins. The control process can be however monitored by the device for position determination of the control member from the control electronic unit. In this case when at least one of the doors is not properly locked, an alarm sound can be released similar to the case with not turned off lights.

It will be understood that each of the elements described above, or two or more together, may also find a useful application in other types of constructions differing from the types described above.

While the invention has been illustrated and described as embodied in an interlocking device for doors of a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An interlocking device for doors and other elements of a motor vehicle, comprising a plurality of locks associated at least with doors, at least one of said locks being a locking cylinder which is actuatable from outside with a key; a holding element; a blocking element; unlocking means; an inner door handle and an outer door handle, said lock having a locking element cooperating with said holding element, said locking element in a closed position being blockable by said blocking element and being unblockable under the action of said unlocking means; a motor; and a control member displaceable by said motor so that a movement of said unlocking means from its position is influenced by said control member, said unlocking means including two independently turnable unlocking levers, one of said unlocking levers being actuatable by said outer door handle and another of said unlocking levers being actuatable by said inner door handle, said control member having control segments with which said unlocking levers individually cooperate.

2. An interlocking device as defined in claim 1, wherein said control segments of said control member have different constructions.

3. An interlocking device as defined in claim 1, wherein said locking element is formed as a turnable latch.

4. An interlocking device as defined in claim 1, wherein said control member has a pair of said control segments which blocks said unlocking levers and another pair of said segments which do not block said unlocking levers.

5. An interlocking device as defined in claim 4, wherein said pairs of segments are at least partially flush with one another.

6. An interlocking device as defined in claim 1; and further comprising a turning frame which is stationary in a normal operation, said control member being rotatably held in said turning frame.

7. An interlocking device as defined in claim 1, wherein said unlocking levers are jointly turnable about an axis and turnable together with said control member.

8. An interlocking device as defined in claim 1, wherein said unlocking levers have ends which are opposite to said axis and provided with coupling means for said door handles.

9. An interlocking device as defined in claim 1, wherein said coupling means includes pins.

10. An interlocking device as defined in claim 8, wherein said coupling means includes ears.

11. An interlocking device as defined in claim 1; and further comprising a turning frame supported in an axle and turnable with said control member from its position in a normal operation by said unlocking means.

12. An interlocking device as defined in claim 11; and further comprising a door lock key bolt with said locking cylinder so that with a not operative motor it can be turned mechanically by the key and release said turning frame.

13. An interlocking device as defined in claim 1; and further comprising a turning frame which in normal operation is stationary and rotatably supports said control member; and an arresting element which prevents a turning back of said locking cylinder after releasing said turning frame.

* * * * *